US011454082B2

(12) United States Patent
Mahalingam et al.

(10) Patent No.: US 11,454,082 B2
(45) Date of Patent: Sep. 27, 2022

(54) ENGINEERED COMPOSITE ASSEMBLY WITH CONTROLLABLE DISSOLUTION

(71) Applicant: Saudi Arabian Oil Company, Dhahran (SA)

(72) Inventors: Sakethraman Mahalingam, Aberdeen (GB); Graham Hitchcock, Aberdeen (GB); Daniele Colombo, Dhahran (SA); Jianhui Xu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 80 days.

(21) Appl. No.: 17/002,438

(22) Filed: Aug. 25, 2020

(65) Prior Publication Data

US 2022/0065068 A1 Mar. 3, 2022

(51) Int. Cl.

| | |
|---|---|
| ***E21B 33/12*** | (2006.01) |
| ***E21B 29/02*** | (2006.01) |
| ***E21B 34/06*** | (2006.01) |

(52) U.S. Cl.

CPC ..... *E21B 33/1208* (2013.01); *E21B 29/02* (2013.01); *E21B 34/063* (2013.01); *E21B 2200/08* (2020.05)

(58) Field of Classification Search

CPC .... E21B 33/1208; E21B 29/02; E21B 34/063; E21B 2200/08

See application file for complete search history.

(56) References Cited

U.S. PATENT DOCUMENTS

| | | | | |
|---|---|---|---|---|
| 8,231,947 | B2 | 7/2012 | Vaidya et al. | |
| 9,109,429 | B2 | 8/2015 | Xu et al. | |
| 9,757,796 | B2 | 9/2017 | Sherman et al. | |
| 9,903,010 | B2 | 2/2018 | Doud | |
| 9,976,381 | B2 | 5/2018 | Martin et al. | |
| 10,352,125 | B2 * | 7/2019 | Frazier | E21B 34/063 |
| 2004/0261999 | A1 * | 12/2004 | Nguyen | C09K 8/80 166/292 |
| 2005/0205266 | A1 * | 9/2005 | Todd | E21B 33/12 166/376 |
| 2008/0202764 | A1 * | 8/2008 | Clayton | E21B 29/02 166/376 |
| 2009/0139720 | A1 * | 6/2009 | Frazier | E21B 34/063 166/295 |
| 2011/0005753 | A1 * | 1/2011 | Todd | E21B 43/267 166/282 |
| 2011/0247833 | A1 * | 10/2011 | Todd | E21B 33/1204 166/386 |

(Continued)

FOREIGN PATENT DOCUMENTS

| | | |
|---|---|---|
| WO | 2015073001 | 5/2015 |
| WO | 2015130419 | 9/2015 |

OTHER PUBLICATIONS

PCT International Invitation to Pay Additional Fees and Where Applicable Protest Fees in International Appln, No. PCT/US2021/047494, dated Nov. 4, 2021, 13 pages.

(Continued)

*Primary Examiner* — Steven A Macdonald

(74) *Attorney, Agent, or Firm* — Fish & Richardson P.C.

(57) ABSTRACT

An exemplary dissolvable assembly is provided. The dissolvable assembly includes a skeleton made from a first material, and a body made from a second material, wherein the first material and the second material dissolve at different rates.

25 Claims, 8 Drawing Sheets

(56) References Cited

U.S. PATENT DOCUMENTS

| | | | | |
|---|---|---|---|---|
| 2013/0160992 | A1 | 6/2013 | Agrawal et al. | |
| 2014/0020708 | A1 | 1/2014 | Kim et al. | |
| 2014/0202712 | A1* | 7/2014 | Fripp | E21B 33/1208 166/377 |
| 2014/0246209 | A1* | 9/2014 | Themig | E21B 23/006 166/374 |
| 2015/0239795 | A1* | 8/2015 | Doud | C06B 45/18 428/649 |
| 2015/0285026 | A1* | 10/2015 | Frazier | E21B 33/134 166/120 |
| 2016/0215205 | A1* | 7/2016 | Nguyen | E21B 43/267 |
| 2016/0369154 | A1* | 12/2016 | Johnson | E21B 43/25 |
| 2017/0030161 | A1* | 2/2017 | Frazier | E21B 43/26 |
| 2017/0204703 | A1* | 7/2017 | Mair | E21B 43/11855 |
| 2018/0223624 | A1* | 8/2018 | Fripp | E21B 43/12 |
| 2018/0238133 | A1* | 8/2018 | Fripp | E21B 29/02 |
| 2018/0371860 | A1* | 12/2018 | Fripp | E21B 29/06 |
| 2019/0106959 | A1* | 4/2019 | Leonard | C22C 22/00 |
| 2019/0169953 | A1* | 6/2019 | Frazier | E21B 33/1208 |
| 2019/0218883 | A1* | 7/2019 | Inglis | F16K 5/06 |
| 2020/0040680 | A1* | 2/2020 | Mhaskar | E21B 34/06 |

OTHER PUBLICATIONS

PCT International Search and Written Opinion in International Appln. No. PCT/US2021/047494, dated Jan. 4, 2022, 20 pages.

"Echo Dissolvable Fracturing Plug," EchoSeries, Dissolvable Fracturing Plugs, Giyphon Oilfield Solutions, Aug. 2018, 1 page.

"TervAlloy Degradable Magnesium Alloys," Terves Engineered Response, Engineered for Enhanced Completion Efficiency, Feb. 2018, 8 pages.

Corona et al., "Novel Washpipe-Free ICD Completion Willi Dissolvable Material," OTC-28863-MS, Offshore Teclmology Conference (OTC), presented at the Offshore Technology Conference. Apr. 30-May 3, 2018, 10 pages.

Takahashi et al., "Degradation Study on Materials for Dissolvable Frac Plugs," URTEC-2901283-MS, Unconventional Resources Technology Conference (URTC), presented at the SPE/AAPG/SEG Unconventional Resources Technologv Conference, Jul. 23-25, 2018, 9 pages.

* cited by examiner

100

300

500

600

700

ENGINEERED COMPOSITE ASSEMBLY WITH CONTROLLABLE DISSOLUTION

TECHNICAL FIELD

The present disclosure is directed to a downhole assembly that is designed to dissolve and disintegrate fully in a controlled manner

BACKGROUND

In the production of hydrocarbons it is often important to temporarily isolate sections of a well from other sections of the well. As used herein, a well includes the bare wellbore, a cased wellbore, production tubing, and the like. Engineered materials are used in many downhole applications in the oil and gas industry. Some materials are engineered to dissolve or disintegrate completely in order to open a previous closed section of the wellbore. The dissolution of the dissolvable or disintegrable material occurs when it comes in contact with the fluid coming out from the well or an externally injected fluid. In these cases, the dissolution process is controlled by the composition of the engineered material and the well fluids, making prediction of the dissolution time, or the time to failure, difficult to predict.

SUMMARY

An embodiment described in examples herein provides a dissolvable assembly. The dissolvable assembly includes a skeleton made from a first material, and a body made from a second material, wherein the first material and the second material dissolve at different rates.

DETAILED DESCRIPTION

Dissolvable materials are used in many applications in both production and drilling operations, typically to temporarily isolate one part of the wellbore from another. For example, dissolvable materials in various forms are used in multi-zone fracture jobs to isolate one fractured zone from another zone that is about to be fractured. The plugs then dissolve when they come in contact with wellbore fluids and all fractured zones become connected. A dissolvable ball and ball seat system is also used in the multi-zone fracture jobs. A further of dissolvable material is used in an inflow control device (ICD) or inflow control valve (ICV) in which the dissolvable material is used to trigger the ICD function in a time-controlling manner. The dissolvable materials can be also used as a trigger mechanism for deployment of downhole tools in a time-controlled manner.

In the case of an ICV, part of the assembly may not dissolve fully. Depending upon the proportion and location of dissolvable content, the valve may operate from fully closed to some fractional opening. For a water-shut-off application, the dissolvable material selection and design may restrict water flow from the particular zone. In particular, the design of the assembly may be such that the undissolved portion of the assembly helps future interventions to shut water off from a zone. For example, the undissolved assembly may have features that enable the installation and locking of a sleeve to stop flow from that particular zone.

However, the dissolution of the material is often uncontrolled and the only means of control is to delay the contact of wellbore fluids with the material. This invention enables the control of such dissolution across the material and over time. As used herein, dissolution includes partial dissolution leading to disintegration and mechanical failure, for example, of a plug into fragments that no longer block the well.

Embodiments described herein provide an engineered composite assembly that is designed to act as a dissolvable assembly and dissolve in a controlled manner. This is achieved by designing one part of the dissolvable assembly to be easier to dissolve than the other. In some embodiments, metals having different galvanic potentials are selected to create parts that dissolve by an internal galvanic corrosion mechanism. In some embodiments, the dissolvable assembly uses electrical energy to control the time for the dissolution, for example, slowing or speeding the dissolution. In embodiments described herein, the dissolvable assembly is made from two or more materials that have different dissolution rates, such as two metal alloys, a metal alloy and a plastic, two plastics, or a material that dissolves in combination with an insoluble material, such as a soluble metal in combination with an insoluble metal or plastic. The different materials are used to form different parts of the dissolvable assembly, such as a skeleton and a body.

Figure 1:
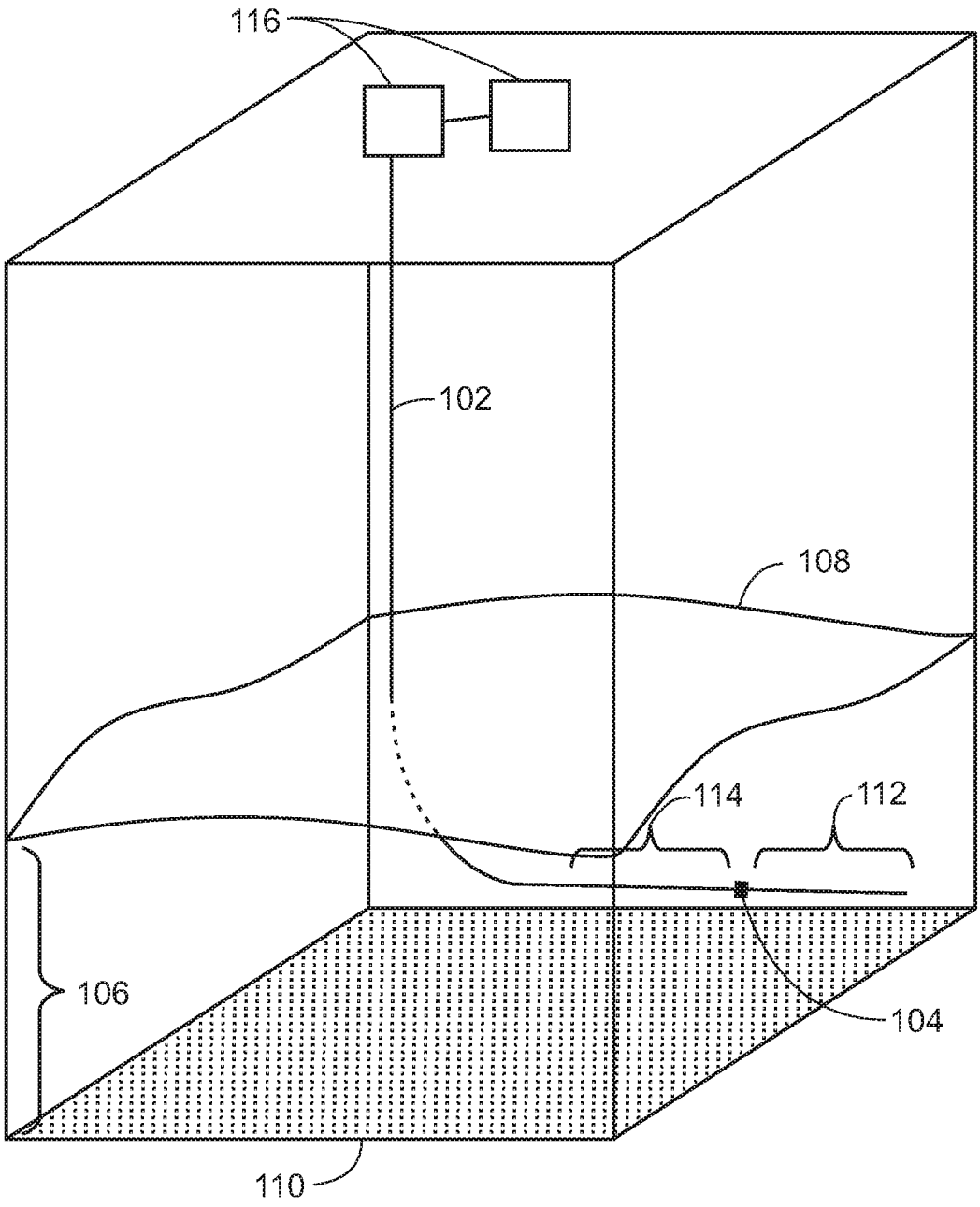
FIG. 1 is a schematic drawing of a wellbore showing the use of a dissolvable assembly for zonal isolation.

FIG. 1 is a schematic drawing 100 of a wellbore 102 showing the use of a dissolvable assembly as a zonal isolation device 104. In the schematic drawing 100, a wellbore 102 is laterally drilled into a reservoir layer 106 line between a cap rock 108 and a water layer 110. A downstream section 112 of the wellbore 102 is isolated from an upstream section 114 of the wellbore 102 by the zonal isolation device 104. This may be performed to protect the downstream section 112 from treatments being used for the upstream section 114. For example, the downstream section 112 may have already been fractured, and the well completion has proceeded to the upstream section 114 to complete that section by fracturing. In some embodiments described herein, the zonal isolation device 104 is an engineered composite assembly that may be installed in the wellbore 102 to protect the downstream section 112 during the fracking of the upstream section 114. The zonal isolation device 104 may then be left in the wellbore 102 and allowed to dissolve. That eliminates the need for retrieving the zonal isolation device 104 using a wireline, or drilling through the zonal isolation device 104, from surface facilities 116, which risks damage to the wellbore 102.

The dissolvable assemblies described herein are not limited to being used as a zonal isolation device 104, but may be used in other applications. For example, the dissolvable assemblies may be used in an ICD in which the dissolvable material is used to trigger the ICD function in a time-controlled manner. It may also be used to create an in-flow control valve (ICV).

Figure 2:
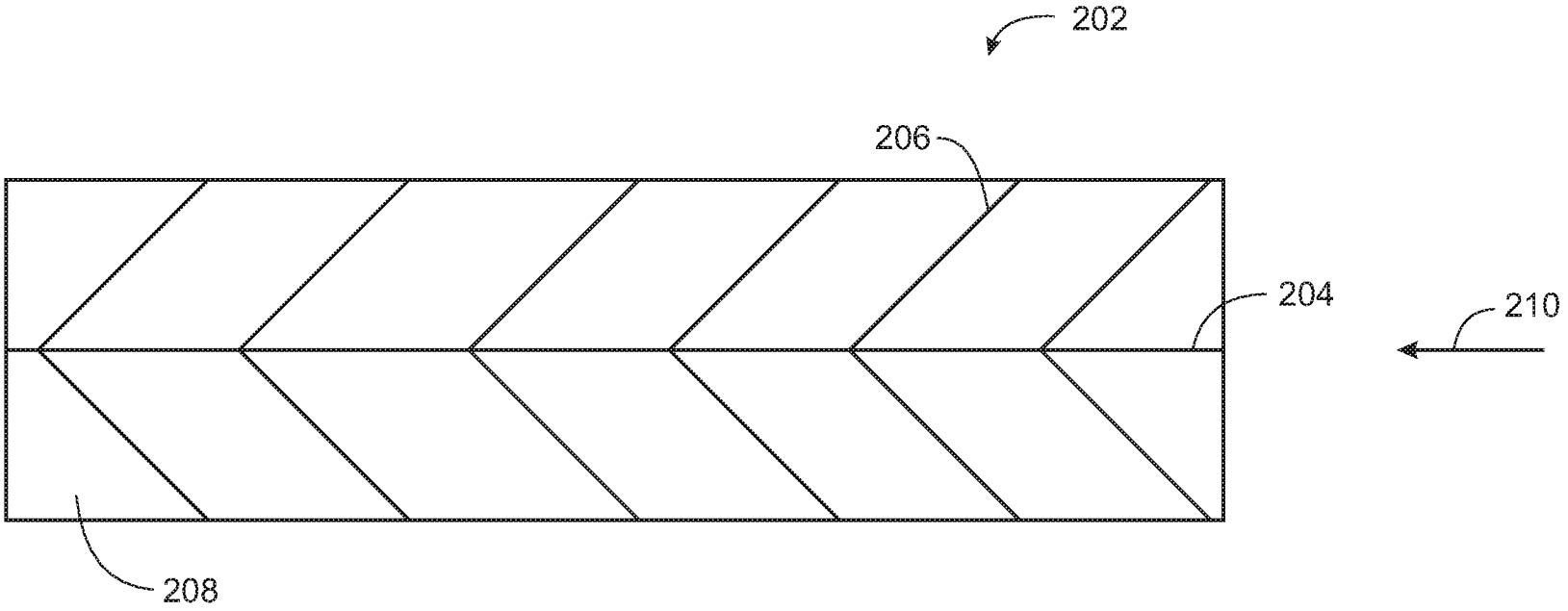
FIG. 2 is a cross-sectional drawing of an engineered composite assembly with a uniform fishbone skeleton for use as a dissolvable assembly.

FIG. 2 is a cross-sectional drawing of an engineered composite assembly 202 with a uniform, fishbone skeleton for use as a dissolvable assembly. In this embodiment, the skeleton includes a central structure 204 and branching ribs 206. The skeleton is formed from a first material (A) and is embedded in a body 208 that is formed from a second material (B). In some embodiments, material A, forming the skeleton, dissolves faster than material B that makes the body of the dissolvable assembly. However, as shown in FIG. 2, the contact area between the skeleton and the outside is limited and consequently, the rate of dissolution is controlled. In another embodiment, material A may dissolve slower than material B and hence protect the rest of the structure from dissolving quickly.

In the engineered composite assembly 202 of FIG. 2, the opening in the ribs 206 of the skeleton may be directed towards high pressure 210 to enhance the strength of the engineered composite assembly 202. However, in some embodiments, material A of the skeleton is mechanically weaker than material B of the body 208 in which the direction of the ribs 206 may not be significant. In some embodiments, as discussed further with respect to FIG. 7, ribs may be included in both directions to protect the engineered composite assembly 202 from stresses originating in both directions, for example, from reservoir pressure below the engineered composite assembly 202 and fracking pressure above the engineered composite assembly 202.

In various embodiments, material A and material B are both dissolvable and formed from magnesium or aluminum alloys, with different dissolution rates. For example, in various embodiments, the difference in the dissolution rates of one of the materials is at least 1.5 times of the other material.

In yet another example, the material B is dissolvable magnesium or dissolvable aluminum alloy, while the material A can be non-dissolvable such as non-dissolvable magnesium or non-dissolvable aluminum alloys or steel or copper alloys. In another scenario, the material A is dissolvable magnesium or dissolvable aluminum alloy, while the material B can be non-dissolvable, such as non-dissolvable magnesium or non-dissolvable aluminum alloys or steel or copper alloys.

The environment for dissolution of metallic materials is typically a water-based brine in a wellbore. The chloride concentration due to salinity can be as low as 200 ppm chloride ion ($Cl^-$) or as high as 50,000 ppm Cr. The higher the ionic concentration, the faster the dissolution rate. The pH value also affects the dissolution rate. A lower pH, for example, an acidic wellbore fluid, increases the dissolution rate.

In embodiments that use non-metallic materials, the mechanical forces acting on the assembly may cause a slow mechanical disintegration, for example, low cycle fatigue. Further, chemical degradation acting on metal parts will speed the degradation. In some embodiments, the structure is designed to allow more and more of the metallic portion of assembly, such as the skeleton, to be exposed to the external environment when mechanical stress is increased.

In some embodiments, the body material is coated over the skeleton material in an open structure. However, in most embodiments, the body will be a solid providing higher mechanical strength.

Materials that can be chosen include magnesium, beryllium, manganese, zinc, chromium and aluminum, which have a tendency to corrode more quickly than other materials that may be used, such as iron, tin, copper, nickel, silver, gold and lead. Further, the metals may be alloyed to increase or decrease their tendency to dissolve. As these materials rank very differently when it comes to mechanical strength the selections can be adjusted to form an assembly with a mechanical structure and dissolution rate that is suited to the application. Other materials may include plastics, such as polyethylene, polypropylene, or other plastics that do not dissolve. Plastics with higher dissolution rates may also be selected, such as polylactic acid (PLA), polyglycolic acid (PGA) and the like.

Figure 3:
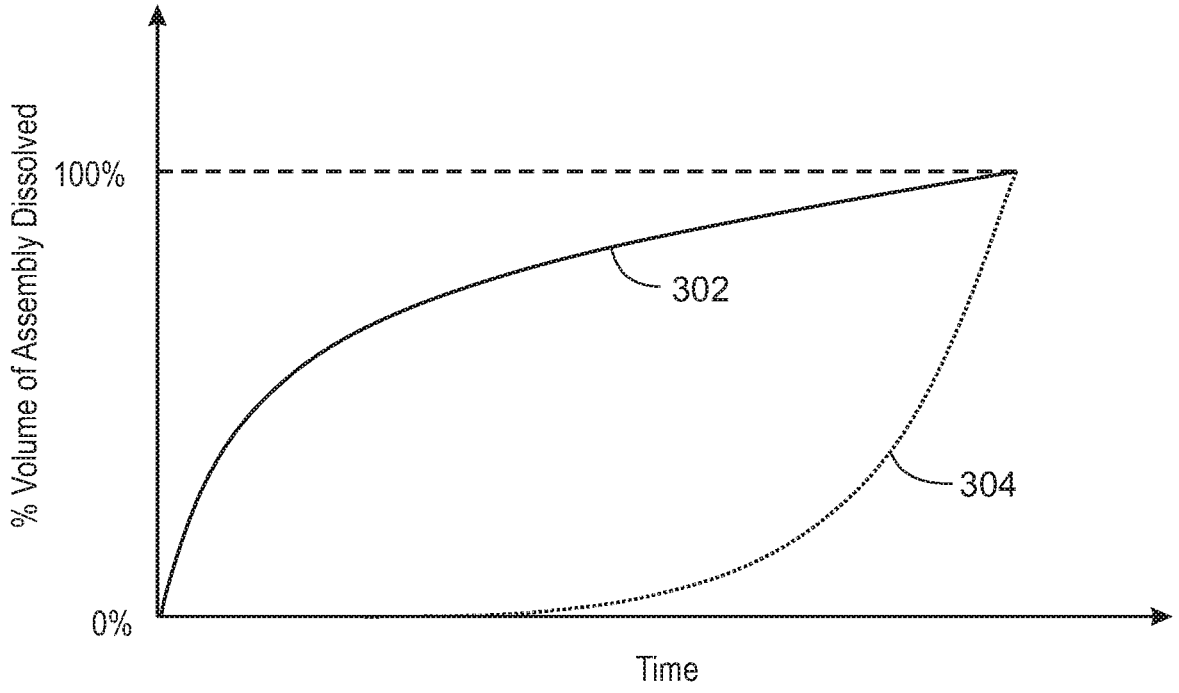
FIG. 3 is a plot of dissolution rates as a function of comparative strength between skeleton and body.

FIG. 3 is a plot 300 of dissolution rates as a function of comparative strength between skeleton and body. If the skeleton is stronger, as shown in plot 302, than the body, a higher volume percent dissolves over time. If the skeleton is weaker, as shown in plot 304, than the body, a lower volume percent dissolves over time. These dissolution rates may be used to design assemblies that lose mechanical strength at a preselected times.

In various embodiments, the galvanic potential and the mechanical strength are used to control these dissolution rates. For example, a dissolvable assembly may be designed with a skeleton having a higher galvanic potential, which is less prone to dissolution, and a higher mechanical strength than the rest of the structure, as shown in plot 302. In this dissolvable assembly, the skeleton will be the last portion of the assembly to dissolve while the rest of the assembly is dissolving relatively quickly.

In another example, a dissolvable assembly may be designed with a skeleton that has a lower galvanic potential and a lower mechanical strength than the body, as shown in plot 304. However, since the skeleton has less surface area exposed, the dissolvable assembly would disintegrate slowly at first, but then disintegrate quite quickly once the skeleton is dissolved fully.

In some embodiments, the selection of the materials may provide a substantially linear dissolution rate with time, which may be desirable as non-linear dissolution may be less repeatable. For example, once a critical % of the volume is dissolved the dissolvable assembly may lose mechanical integrity. If the dissolvable assembly is holding pressure, it may be structurally incapable of holding that pressure once 30% of the dissolvable assembly is dissolved. Accordingly, the design parameters for the dissolvable assembly may target getting a linear dissolution rate until a critical percent of the volume is reached, after which a nonlinear dissolution may provide for a faster removal of the remaining fragments.

In addition to galvanic potential and mechanical strength, an important property of the materials, such as metallic materials used for the skeleton or the body, is the adhesion between each other in a structure. The interface between materials is often the weakest point in many assemblies. In case of metallic materials, the primary mode of dissolution is chemical, for example, when the dissolvable assembly comes in contact with the medium around it. The mechanical disintegration of the assembly is secondary but has a controlling influence on the rate of dissolution. The texture of the outer surface of the assembly may play a secondary role in the dissolution rate, for example, increased roughness may offer more open sites for the dissolution to start.

In the case of non-metallic materials, the mechanical strength of the individual materials is the primary driver while chemical dissolution is the controlling influence. The mechanical strength of non-metallic materials is dictated by the internal cohesion of the material. For example, if a composite made out of ceramic powder and a polymer is used as the material for the body of the dissolvable assembly, the cohesion within the composite will dictate the mechanical strength and determine the rate of dissolution.

When both metals and non-metals are used in a dissolvable assembly, any of the properties may be used to control the dissolution rates. For example, in some embodiments, a material that dissolves quickly, such as a magnesium alloy, may be used as the skeleton with an insoluble plastic, such as polyethylene, as the body. The skeleton may be designed to have multiple branches, e.g., as a branching fractal pattern, that isolate portions of the polyethylene from other portions, allowing the assembly to disintegrate as the skeleton dissolves. As polyethylene has a density lower than water, the fragments may float upwards in the drilling fluid, allowing their retrieval. Generally, the desired outcome is to design assemblies with differing rates of dissolution depending on the application.

Figure 4:
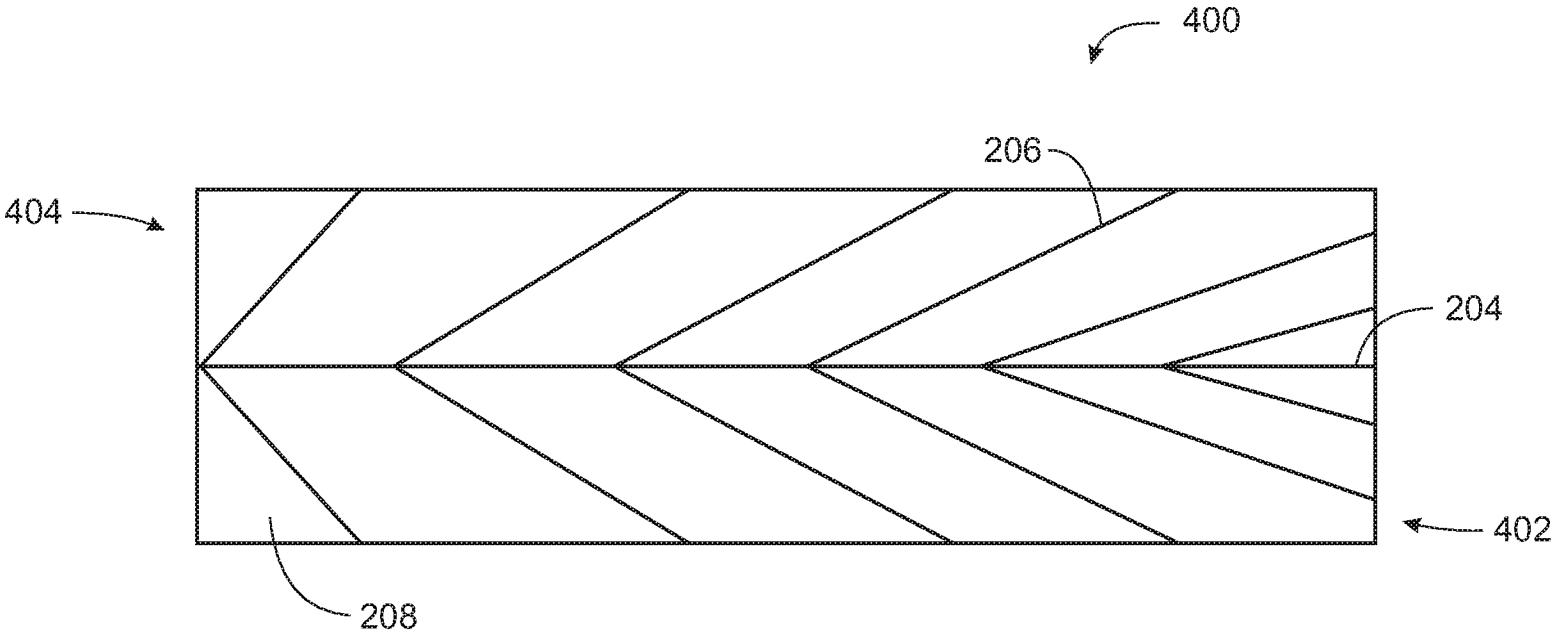
FIG. 4 is a cross-sectional of a skeleton design that is varied across the assembly.

FIG. 4 is a cross-sectional of a skeleton design 400 that is varied across the dissolvable assembly. Like numbered items are as described with respect to FIG. 2 as shown in FIG. 4, in some embodiments, the design of the skeleton is varied across the dissolvable assembly to make one end of the dissolvable assembly dissolve faster than the other. For example, the ribs 206 of the skeleton may be closer together at a first end 402 and farther apart at a second end 404. In this example, the more closely spaced ribs 206 at the first end 402 of the dissolvable assembly may lead to faster dissolution at the first end 402. In other embodiments, the ribs 206 of the skeleton are curved in a similar fashion to the veins in a leaf. The main veins could be sub-divided into smaller and smaller veins to provide more granularity and spatial control to the dissolution of the engineered assembly, for example, in a fractal type pattern.

Figure 5:
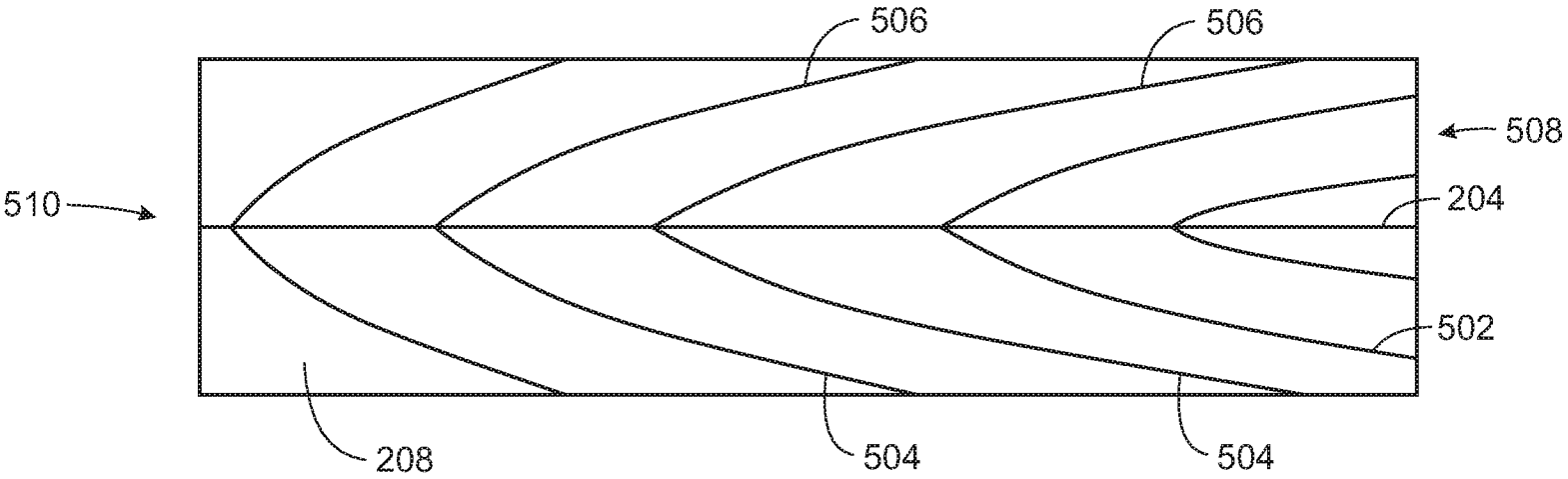
FIG. 5 is a cross sectional view of an engineered composite assembly with a non-uniform leaf-like skeleton made of multiple materials.

FIG. 5 is a cross sectional view of an engineered composite assembly 500 with a non-uniform leaf-like skeleton made of multiple materials used as a dissolvable assembly. In some embodiments, the ribs of the skeleton are formed from multiple different materials with varying dissolution rates. For example, the body 208 may be made from a first material, while some of the ribs 502 may be formed from a second material, other ribs 504 may be formed from a third material, and yet other ribs 506 may be formed from a further material. Any of the materials may be selected as described with respect to materials A and B of FIG. 2. In some embodiments, more easily dissolved materials are used for ribs closer to a first end 508 while less easily dissolved materials are used for ribs closer to a second end 510. Initial exposure of materials may have less surface area, and thus, more easily dissolved materials may break down faster. Similarly, as more of the dissolvable assembly degrades, the dissolution rate may slow. This may be used to adjust the dissolution rate, for example, to be closer to linear.

Figure 6:
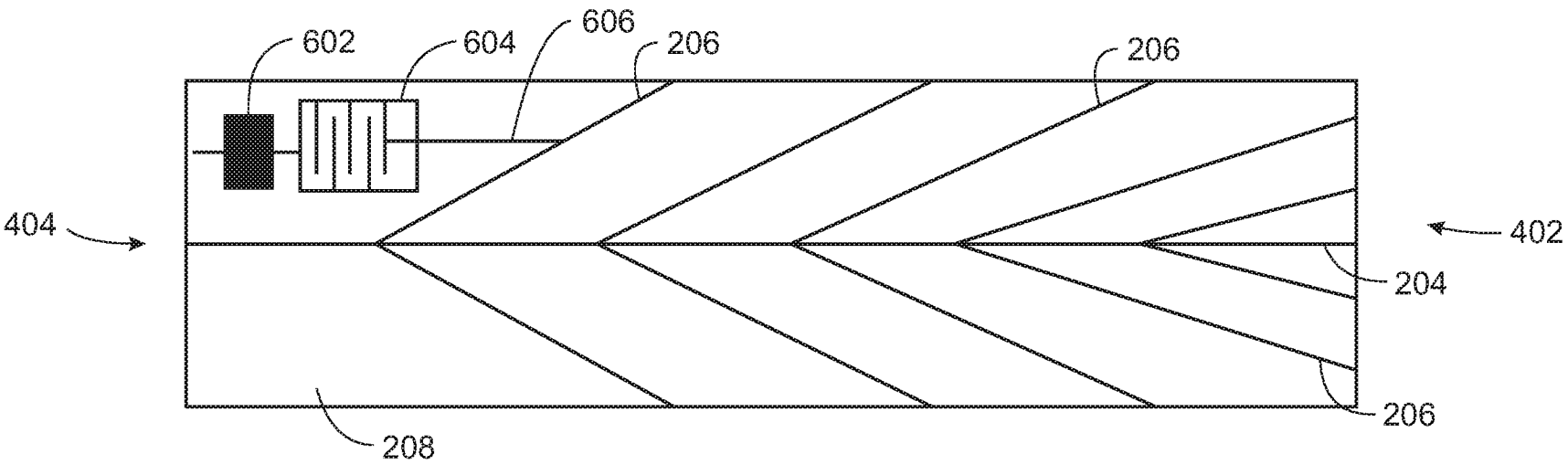
FIG. 6 is a cross-sectional view of an engineered composite assembly that includes circuits to provide active galvanic protection.

FIG. 6 is a cross-sectional view of an engineered composite assembly 600 that includes circuits 602 and 604 to provide active galvanic protection to the dissolvable assembly. Like numbered items are as described with respect to FIGS. 2 and 4. In some embodiments, the dissolution rate may be controlled by electrical potentials, for example, using active galvanic protection. The engineered composite assembly 600 includes an energy storage device 602, such as a capacitor or battery. The energy from the energy storage device 602 is used to bias the structure electrically, for example, with respect to a surrounding tubular, to either promote faster or slower dissolution. In some embodiments, a generator 604 is included to harvest energy from the surroundings, which is used to charge the energy storage device 602. For example, the generator 604 may include a piezoelectric material that harvests energy from the vibrations and pressure fluctuations surrounding the engineered assembly. The energy storage device 602 provides energy for protection in case the extra vibrational pressure fluctuations are insufficient to provide enough energy. The energy storage device 602 also smooth out fluctuations in the voltage levels from the generator 604.

In some embodiments, the negative terminal 606 is directly coupled to elements of the engineered composite assembly 600, such as the ribs 206 or central structure 204 of the skeleton, to slow dissolution as shown in FIG. 6. In other embodiments, for example, as discussed with respect to FIG. 7, a controller couples the power to the elements of the engineered composite assembly 600. In these embodiments, the controller may be used to start the galvanic protection, end the galvanic protection, or reverse the polarity to accelerate the dissolution. In the embodiments in which the skeleton is made of pure magnesium, the energy storage device 602 provides 1.75V to provide protection against dissolution. In some embodiments, once the dissolvable assembly disintegrates, the circuits 602 and 604 will also disintegrate. In other embodiments, the circuits 602 and 604 is constructed into a low density casing, such as a polyethylene material, which will allowed the casing with the circuits 602 and 604 to float up in the wellbore fluids for retrieval.

As described herein, the generator 604 may be a piezoelectric device that produces a voltage when it is subjected to mechanical strain. A typical piezoelectric material used in a piezoelectric device is lead-zirconate-titanate commonly known as PZT. As the engineered composite assembly 600 is made from materials having different mechanical characteristics, it is possible to attach the two sides of a small PZT tablet or disc like device to two different materials. For example, one end of the PZT disc may be connected to a rib 206 in the skeleton whereas the other side is embedded in the body 208. If the skeleton is a stiffer material compared to the body, for example, if the rib 206 is a metal and the body is a plastic 208, the PZT material is compressed and stretched between the two materials in the engineered composite assembly 600 as the engineered composite assembly 600 is stressed.

The strain on the piezoelectric device results in a small voltage that is then stored in the energy storage device 602, such as a capacitor, to provide galvanic protection. The generation of the voltage depends, at least in part, on the rate of change of strain with time. This means that generation of voltage may be controlled by subjecting the engineered composite assembly 600 to external pressure pulses from a distance. The disintegration may be controlled by the pulses, for example, terminating the pulses to allow the galvanic protection to end resulting in the dissolution of the engineered composite assembly 600.

The pressure pulses may also be a way of communicating and controlling the disintegration of the dissolvable assembly. For example, in some instances, it is possible to have a controller connected to the piezoelectric generator and capacitor. The electronic circuit may be embedded with simple rules of when to change the galvanic protection offered to the dissolvable assembly. The rules may even include counting the pressure pulses or features of the pressure pulse like the width and height. The piezoelectric generator ensures that the dissolvable assembly is able to generate its own power.

In some embodiments in which the energy storage device 602 is a battery, the battery is installed just before the assembly is launched into use. In other embodiments using a battery, the battery is a lithium ion battery with a long storage life. As described herein, a controller included with a battery may provide communications and operational control, for example, following simple rules. For example, in some embodiments, the galvanic protection is turned off after a certain amount of time. In other embodiments, a strain gauge attached to the controller triggers the increase or decrease in mechanical protection based on the measured strain on the dissolvable assembly. Generally, the battery will be of a sufficiently small size that the size of the battery and controller does not matter after the engineered composite assembly 600 dissolves. In some embodiments, the battery may disintegrate as it comes in contact with the external environment once the assembly starts to disintegrate.

The energy storage circuitry 602 can be modified to provide alternating current. Higher frequency electrical currents travel through the skin rather than the bulk of metallic materials due to the skin effect, as the induced magnetic field around the metal structure pulls the electrons closer to the outer surface of the metal. By providing an alternating current, the surface of the dissolvable assembly may be made to dissolve slower or faster without disturbing the interior of the dissolvable assembly.

In some embodiments, the dissolution of the dissolvable assembly may be triggered an external element, such as a dissolvable composite ball, may be used to activate or deactivate the circuits 602 and 604. For example, the ball may provide a mechanism to block the flow of fluid in and around the engineered assembly fully or partially and create the conditions needed for the energy harvesting system to work.

Figure 7:
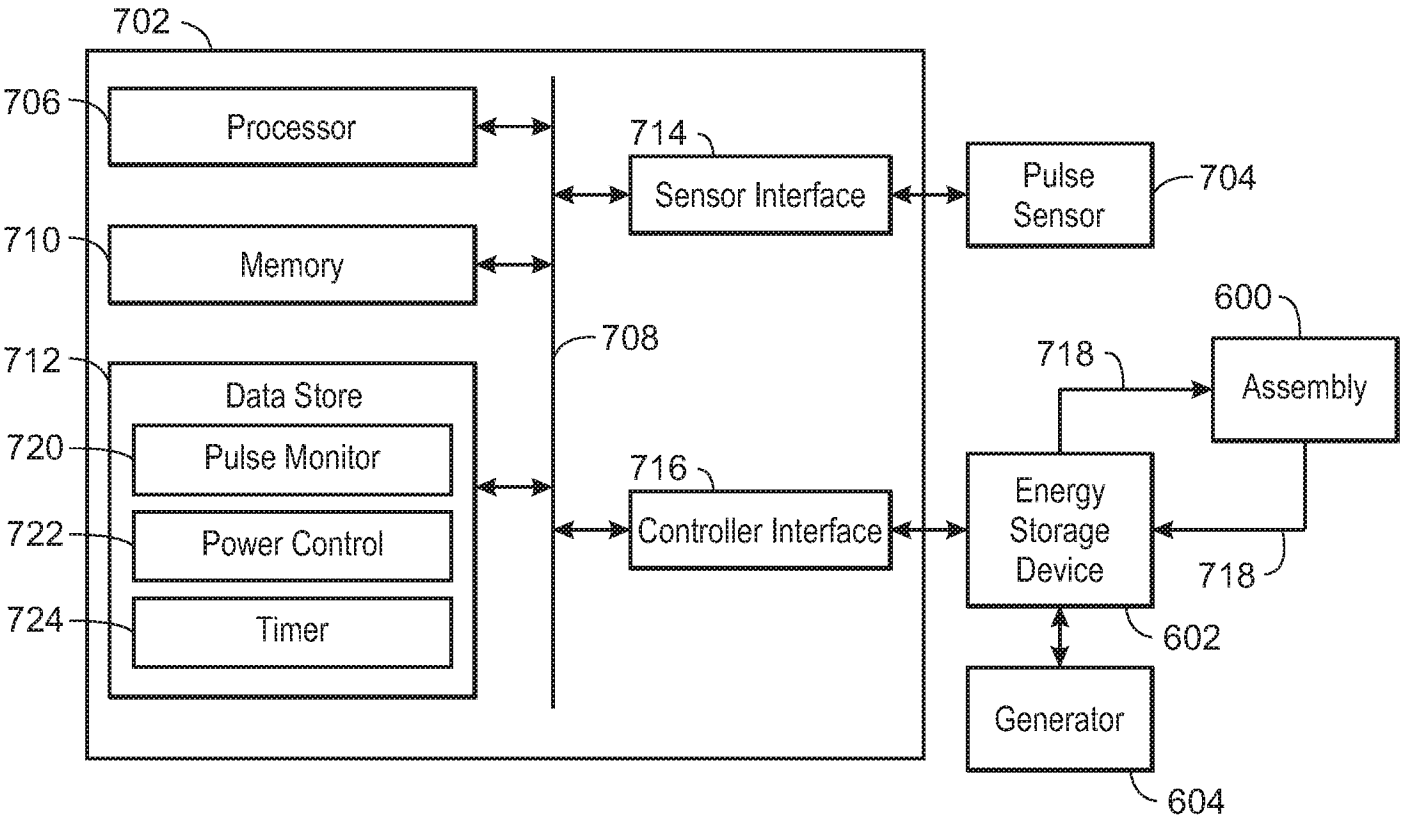
FIG. 7 is a block diagram of a system that may be used for controlling the dissolution of an engineered composite assembly.

FIG. 7 is a block diagram of a system 700 that may be used for controlling the dissolution of a dissolvable assembly, such as the engineered composite assembly 600 of FIG. 6. Like numbered items are as described with respect to FIG. 6. The system 700 includes a controller 702, a pulse sensor 704, and power circuits 602 and 604. In some embodiments, the controller 702 that is mounted inside the dissolvable assembly is programmable. In other embodiments, the controller 702 is a simple timer that is mounted inside the dissolvable assembly. The timer may be initiated by power generated by the generator 604.

The controller 702 includes a processor 706. The processor 706 may be a microcontroller, a microprocessor, an ultra-low-voltage processor, or an embedded processor. In some embodiments, the processor 706 may be part of a system-on-a-chip (SoC) in which the processor 706 and the other components of the controller 702 are formed into a single integrated electronics package. In various embodiments, the processor 706 may include processors from Intel® Corporation of Santa Clara, Calif., from Advanced Micro Devices, Inc. (AMD) of Sunnyvale, Calif., from ARM Holdings, LTD., Of Cambridge, England, or from Texas Instruments of Dallas, Tex. Any number of other processors from other suppliers may also be used.

The processor 706 may communicate with other components of the controller 702 over a bus 708. The bus 708 may include any number of technologies, such as industry standard architecture (ISA), extended ISA (EISA), peripheral component interconnect (PCI), peripheral component interconnect extended (PCIx), PCI express (PCIe), or any number of other technologies. The bus 708 may be a proprietary bus, for example, used in an SoC or microcontroller based system. Other bus technologies may be used, in addition to, or instead of, the technologies above.

The bus 708 may couple the processor 706 to a memory 710. In some embodiments, such as in microcontrollers and other small-scale control units, the memory 710 is integrated with a data store 712 used for long-term storage of programs and data. The memory 710 include any number of volatile and nonvolatile memory devices, such as volatile random-access memory (RAM), static random-access memory (SRAM), flash memory, and the like. In smaller devices, such as microcontrollers, the memory 710 may include registers associated with the processor itself. The data store 712 is used for the persistent storage of information, such as data, applications, operating systems, and so forth. The data store 712 may be a nonvolatile RAM, a solid-state disk drive, or a flash drive, among others.

The bus 708 couples the processor 706 to a sensor interface 714. The sensor interface 714 connects the controller 702 to the sensors used to monitor for communications, environmental parameters, and the like. In some embodiments, the sensor interface 714 is an analog-to-digital converter (ADC), an I2C bus, a serial peripheral interface (SPI) bus, or a Fieldbus®, and the like. In some embodiments, the sensors may include a pulse sensor 704. However, the system 700 is not limited to a pulse sensor 704, but may include other sensors, such as pH sensors, current sensors, voltage sensors, or ionic concentration sensors, among others.

In some embodiments, the pulse sensor 704 is an ultrasonic transducer configured to detect ultrasonic pulses transmitted from the surface, for example, through the wellbore fluids. In other embodiments, the pulse sensor 704 is a microelectro-mechanical system (MEMS) pressure sensor used to detect pressure pulses in the wellbore fluids. In some embodiments, both ultrasonic transducers and pressure sensors are used, for example, wherein the ultrasonic transducer is used to accept control pulse streams for the controller.

The bus 708 couples the processor 706 to a control interface 716 that is used to couple the controller 702 to the energy storage device 602. In some embodiments, the controller interface 716 is a bank of relays, a bank of MOSFET power controllers, a serial peripheral interface (SPI), or a Fieldbus, and the like. In some embodiments, the controls include power controls in the energy storage device 602 configured to provide power to portions of the dissolvable assembly through power lines 718. In some embodiments, the controls allow the polarity of the power lines 718 to be reversed to either protect the dissolvable assembly from dissolution or to enhance the dissolution of the dissolvable assembly.

The data store 712 includes blocks of stored instructions that, when executed, direct the processor 706 to implement the functions of the controller 702. The data store 712 includes a block 720 of instructions to direct the processor 706 to monitor the pulse sensor 704 for pressure pulses, ultrasonic communication pulses, or both. The block 720 of instructions may include instructions to direct the processor to count the number of pressure pulses for activation or deactivation of the galvanic protection. The ultrasonic communication pulses may include more detailed commands, such as reversing the polarity, increasing the power level, and the like.

The data store 712 includes a block 722 of instructions to direct the processor 706 to activate the energy storage device 602 to provide energy for the galvanic protection to the engineered composite assembly 600 through the power lines 718. The block 722 of instructions also includes instructions to direct the processor to reverse the polarity of the energy to accelerate the dissolution of the dissolvable assembly.

In some embodiments, the data store 712 includes a block 724 of instructions to direct the processor to function as a timer. For example, at a particular time after deployment, the block 724 of instructions may direct the processor 706 to activate the galvanic protection from the energy storage device 602. At another time after deployment, the block 724 of instructions may direct the processor 706 to deactivate the galvanic protection or reverse polarity.

Figures 8A, 8B, 8C, 8D, 8E:
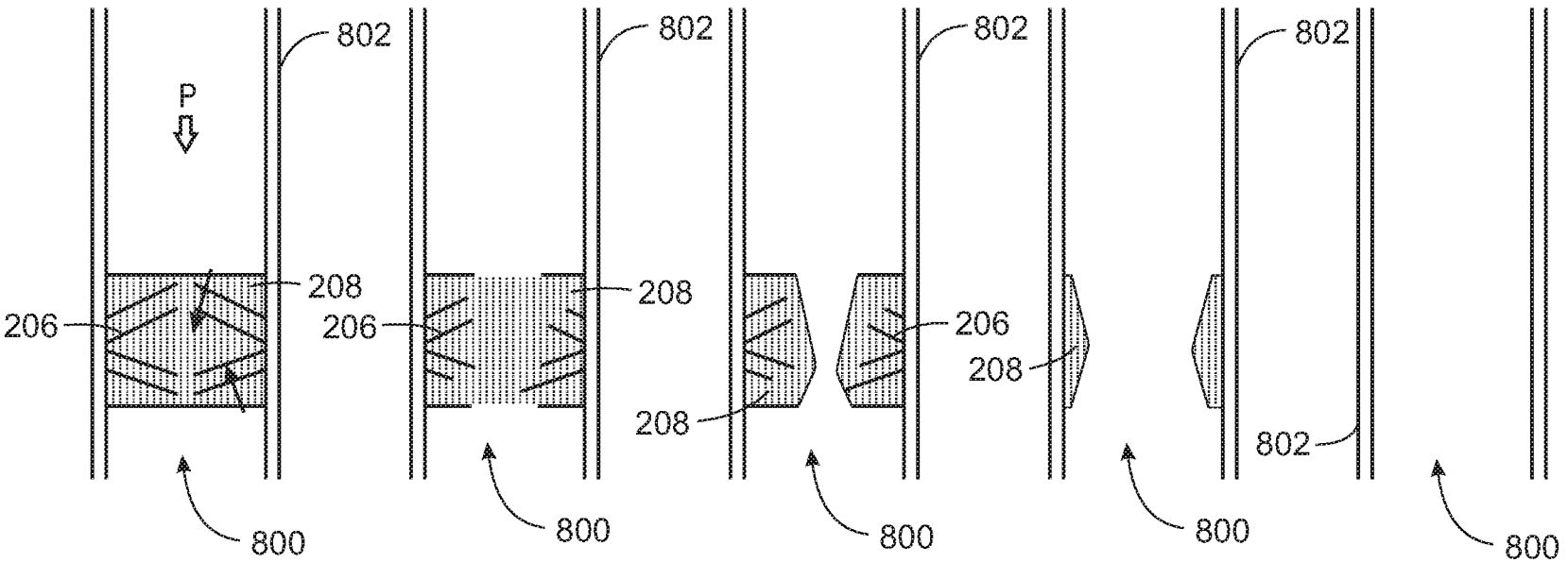
FIGS. 8A-8E are a sequence of schematic drawings showing the dissolution of an engineered composite assembly used as a plug in a wellbore.

FIGS. 8A-8D are a sequence of schematic drawings showing the dissolution of a dissolvable assembly used as a plug 800 in a wellbore 802. Like numbered items are as described with respect to FIG. 2. As shown in FIG. 8A, the ribs 206 do not have to be attached to a central structure, but may be placed in any sort of configuration useful for the task. In the configuration in FIG. 8A, the ribs project out from the sides of the plug. In this embodiment, avoiding the central structure provides control over the dissolution of the plug 800. As the middle portion, or body 208, dissolves the pressure retention of the dissolvable plug collapses.

FIG. 8A is a drawing of the plug 800 immediately after installation in the wellbore 802. FIG. 8B is a drawing of the plug 800 after dissolution has begun, but enough strength is retained to maintain the pressure. As shown in FIG. 8C, at some point, the plug 800 loses mechanical integrity and can no longer hold back the pressure, which blows through the center of the plug 800. The remaining portions of the plug 800 then erode away, as shown in FIGS. 8D and 8E.

The disclosed engineered composite assembly designed to dissolve and disintegrate fully in a controlled manner has many potential uses in downhole drilling and production application where existing technologies have limitations. One such example is a downhole tubing or casing testing plug. Another such example is a dissolvable ball and ball seat system used in the multi-zone fracture jobs. Yet another application is an inflow control device (ICD) using dissolvable material to trigger the ICD function in a time-controlling manner.

An embodiment described in examples herein provides a dissolvable assembly. The dissolvable assembly includes a skeleton made from a first material, and a body made from a second material, wherein the first material and the second material dissolve at different rates.

In an aspect, a rate of dissolution of the first material is at least 1.5 times a rate of dissolution of the second material. In an aspect, a rate of dissolution of the second material is at least 1.5 times a rate of dissolution of the first material.

In an aspect, the first material, the second material, or both include a magnesium alloy. In an aspect, the first material, the second material, or both include an aluminum alloy.

In an aspect, the first material or the second material is a resistant material that is not dissolvable. In an aspect, the resistant material is a non-dissolvable aluminum alloy, a steel alloy, or a copper alloy, or any combinations thereof. In an aspect, the first material, the second material, or both include a dissolvable polymer.

In an aspect, the skeleton includes a fishbone pattern in which ribs of the first material branch from a central structure formed from the first material. In an aspect, the skeleton comprises a fractal structure in which the ribs branching from the central structure further branch to form smaller ribs at least once. In an aspect, wherein the skeleton includes at least two materials.

In an aspect, the dissolvable assembly includes an energy storage device coupled to the skeleton, the body, or both to provide galvanic protection from dissolution for a selected period of time. In an aspect, the energy storage device includes a battery.

In an aspect, the energy storage device includes a capacitor. In an aspect, the dissolvable assembly includes a piezoelectric generator to charge the capacitor. In an aspect, the piezoelectric generator is coupled between the skeleton and the body, and wherein the piezoelectric generator harvests energy from pressure fluctuations around the dissolvable assembly.

In an aspect, the dissolvable assembly includes a controller coupled to the energy storage device to control current from the energy storage device. In an aspect, the controller includes code that, when executed by a processor, stops the current after a predetermined time, allowing the dissolvable assembly to dissolve. In an aspect, the controller includes code that, when executed by a processor, decodes a pulse train in liquid around the dissolvable assembly and, in response, stops the current allowing the dissolvable assembly to dissolve.

In an aspect, the dissolvable assembly includes a downhole plug. In an aspect, the downhole plug includes a fracturing plug. In an aspect, the downhole plug includes a casing test plug. In an aspect, the downhole plug includes a bridge plug.

In an aspect, the dissolvable assembly includes a downhole ball and ball seat system. In an aspect, the dissolvable assembly includes a downhole inflow control device.

Other implementations are also within the scope of the following claims.

What is claimed is:

1. A dissolvable assembly comprising:

a skeleton made from a first material; and a body made from a second material, wherein the first material and the second material dissolve at different rates, and wherein the skeleton comprises a fishbone pattern in which ribs of the first material branch from a central structure formed from the first material, and wherein the skeleton comprises a fractal structure in which the ribs branching from the central structure further branch to form smaller ribs at least once.

2. The dissolvable assembly of claim 1, wherein a rate of dissolution of the first material is at least 1.5 times a rate of dissolution of the second material.

3. The dissolvable assembly of claim 1, wherein a rate of dissolution of the second material is at least 1.5 times a rate of dissolution of the first material.

4. The dissolvable assembly of claim 1, wherein the first material, the second material, or both comprise a magnesium alloy.

5. The dissolvable assembly of claim 1, wherein the first material, the second material, or both comprise an aluminum alloy.

6. The dissolvable assembly of claim 1, wherein the first material or the second material is a resistant material that corrodes more slowly than the other material.

7. The dissolvable assembly of claim 6, wherein the resistant material is an aluminum alloy, a steel alloy, or a copper alloy, or any combinations thereof.

8. The dissolvable assembly of claim 1, wherein the first material, the second material, or both comprise a dissolvable polymer.

9. The dissolvable assembly of claim 1, wherein the skeleton comprises at least two materials.

10. The dissolvable assembly of claim 1, comprising an energy storage device coupled to the skeleton, the body, or both to provide galvanic protection from dissolution for a selected period of time.

11. The dissolvable assembly of claim 10, where the energy storage device comprises a battery.

12. The dissolvable assembly of claim 10, wherein the energy storage device comprises a capacitor.

13. The dissolvable assembly of claim 12, comprising a piezoelectric generator to charge the capacitor.

14. The dissolvable assembly of claim 13, wherein the piezoelectric generator is coupled between the skeleton and the body, and wherein the piezoelectric generator harvests energy from pressure fluctuations around the dissolvable assembly.

15. The dissolvable assembly of claim 10, comprising a controller coupled to the energy storage device to control current from the energy storage device.

16. The dissolvable assembly of claim 15, wherein the controller comprises code that, when executed by a processor, stops the current after a predetermined time, allowing the dissolvable assembly to dissolve.

17. The dissolvable assembly of claim 15, wherein the controller comprises code that, when executed by a processor, decodes a pulse train in liquid around the dissolvable assembly and, in response, stops the current allowing the dissolvable assembly to dissolve.

18. The dissolvable assembly of claim 10, comprising a downhole ball and ball seat system.

19. The dissolvable assembly of claim 10, comprising a downhole inflow control device.

20. The dissolvable assembly of claim 1, comprising a downhole plug.

21. The dissolvable assembly of claim 20, wherein the downhole plug comprises a fracturing plug.

22. The dissolvable assembly of claim 20, wherein the downhole plug comprises a casing test plug.

23. The dissolvable assembly of claim 20, wherein the downhole plug comprises a bridge plug.

24. The dissolvable assembly of claim 1, comprising a downhole ball and ball seat system.

25. The dissolvable assembly of claim 1, comprising a downhole inflow control device.

* * * * *